US011705653B2

(12) United States Patent
Obata

(10) Patent No.: US 11,705,653 B2
(45) Date of Patent: Jul. 18, 2023

(54) CONNECTOR ATTACHABLE TO A FLAT CABLE AND CONNECTABLE TO A COUNTERPART CONNECTOR

(71) Applicant: JAPAN AVIATION ELECTRONICS INDUSTRY, LIMITED, Tokyo (JP)

(72) Inventor: Yusuke Obata, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 40 days.

(21) Appl. No.: 17/514,570

(22) Filed: Oct. 29, 2021

(65) Prior Publication Data

US 2022/0190501 A1 Jun. 16, 2022

(30) Foreign Application Priority Data

Dec. 15, 2020 (JP) ..... 2020-207489

(51) Int. Cl.
*H01R 12/77* (2011.01)
*H01R 12/79* (2011.01)

(52) U.S. Cl.
CPC ..... *H01R 12/778* (2013.01); *H01R 12/79* (2013.01)

(58) Field of Classification Search
None
See application file for complete search history.

(56) References Cited

U.S. PATENT DOCUMENTS 5,967,833 A 10/1999 Cachina
6,551,121 B1 4/2003 Li et al.
7,367,837 B2 * 5/2008 Pabst ..... H01R 13/5816 439/468
2010/0190373 A1 7/2010 Yeh
2017/0324178 A1 11/2017 Liang et al.
2017/0324179 A1 11/2017 Ito et al.

FOREIGN PATENT DOCUMENTS

DE 202012005124 8/2012
JP 2007-141784 6/2007
JP 6664111 B2 3/2020
WO 98/33246 7/1998

OTHER PUBLICATIONS

Extended European Search Report issued in Corresponding EP Application No. 21204617, dated Apr. 8, 2022.
Office Action issued in Corresponding EP Patent Application No. 21204617.1, dated Feb. 21, 2023.

* cited by examiner

*Primary Examiner* — Ross N Gushi
(74) *Attorney, Agent, or Firm* — Greenblum & Bernstein, P.L.C.

(57) ABSTRACT

A connector that is attachable to an end of a flat cable and is connectable to a counterpart connector includes a housing having a plate-shaped portion and a terminal accommodating portion, and a socket terminal housed in the terminal accommodating portion. The socket terminal has a box portion in which a pin terminal of the counterpart connector is to be inserted, and a spring portion having a cantilever shape, the spring portion extending from the box portion and protruding onto the plate-shaped portion. The end of the flat cable is to be interposed between the plate-shaped portion and the spring portion of the socket terminal. The terminal accommodating portion receives part of force that the spring portion receives from the flat cable.

4 Claims, 15 Drawing Sheets

CONNECTOR ATTACHABLE TO A FLAT CABLE AND CONNECTABLE TO A COUNTERPART CONNECTOR

TECHNICAL FIELD

The present invention relates to a connector connectable to a counterpart connector having pin terminals and attachable to a flat cable at an end thereof having lands for electrical contacts.

BACKGROUND ART

FIGS. 1 and 2 show a plug connector 10 described in Japanese Registered Patent No. 6664111 as a prior art of this type of connector. Specifically, FIG. 1 shows an aspect in which the plug connector 10 is attached to a flexible flat cable (FPC) 20, and FIG. 2 shows the plug connector 10 attached to the FPC 20, together with a receptacle connector 30 into which the plug connector 10 is to be fitted.

The plug connector 10 includes a rectangular parallelepiped plug housing 11 and plug terminals 12 housed inside the plug housing 11. The plug terminals 12 are arranged in a row laterally (in a horizontal direction) in the plug housing 11.

The FPC 20 includes FPC terminals 23 which are formed by exposing conductor layers 22 in a connection region 21 to be connected to the plug connector 10. Coupling parts 12*a* of the plug terminals 12 are located on and soldered to the FPC terminals 23, whereby the plug terminals 12 of the plug connector 10 are connected to the FPC terminals 23 of the FPC 20.

As described above, in the conventional plug connector 10 to be attached to the FPC 20, the plug terminals 12 of the plug connector 10 and the FPC terminals 23 of the FPC 20 are all connected by soldering. In order to excellently solder the coupling parts 12*a* of all the plug terminals 12 to the FPC terminals 23, the coplanarity of the coupling parts 12*a* of the plug terminals 12 is a major factor, and in that respect, such a soldering-based connection is not good in workability.

SUMMARY OF THE INVENTION

In view of this problem, an object of the present invention is to provide a connector which is attachable to an end of a flat cable and can be easily connected to the flat cable. Here, the flat cable means a deformable sheet-shaped cable such as a flexible printed circuit board (FPC) cable or a flexible flat cable (FFC), and these cables are generically named as "flat cable".

Technical matters described herein neither intend to explicitly or implicitly limit the invention recited in the claims nor express the possibility of accepting such a limitation by persons other than those who benefit from the present invention (for example, the applicant and proprietors), and are merely described for ease of understanding of the gist of the present invention. The outline of the present invention from another point of view can be understood from, for example, the claims at the time of filing this patent application.

The connector of the present invention is a connector that is connectable to a counterpart connector having a pin terminal and is attachable to a flat cable at an end thereof having a land for an electrical contact.

The connector includes a housing and a socket terminal.

The housing includes a plate-shaped portion and a terminal accommodating portion continuous with the plate-shaped portion. The terminal accommodating portion has an accommodating hole. The accommodating hole penetrates through the terminal accommodating portion and has an end that is open to the plate-shaped portion. The accommodating hole holds the socket terminal inside thereof.

The socket terminal includes a box portion and a spring portion. The box portion is used for receiving the pin terminal of the counterpart connector. Thus, the box portion will be in direct contact with the pin terminal of the counterpart connector. The spring portion has a cantilever shape and extends from the box portion, through the end of the accommodating hole, onto the plate-shaped portion.

The spring portion separates, in response to insertion of the end of the flat cable into the connector, from the plate-shaped portion in order to make space for the end of the flat cable, make contact with the land of the flat cable after the insertion of the end of the flat cable, and furthermore make contact with the terminal accommodating portion to transmit to the terminal accommodating portion part of force that the spring portion receives from the end of the flat cable.

In one aspect, the accommodating hole of the terminal accommodating portion has, at an inner surface thereof, a protrusion protruding from the inner surface. After the insertion of the end of the flat cable, the protrusion serves as a supporter to give the spring portion a support point that is located between, exclusively, a base end of the spring portion and a free end of the spring portion, and receives the part of force that the spring portion receives from the flat cable. The base end of the spring portion serves as a so-called "fixed end" regardless of the insertion of the end of the flat cable. In the connector, the contact between the spring portion and the protrusion, which will be caused by the insertion of the end of the flat cable into the connector, will provide the cantilever—that is, the spring portion—with the new support point and effect changes in the leverage of the cantilever.

In another aspect, the spring portion has a bridge cut mark that is located between, exclusively, the base end of the spring portion and a contact portion of the spring portion. The contact portion is used for a contact with the land. The contact portion in whole is plated. The bridge cut mark is an evidence of cutting of a bridge that is used for connecting the socket terminal to another socket terminal in a manufacturing process of the socket terminal. The spring portion has a wider width at the bridge cut mark, and preferably has, at the bridge cut mark, a width wider than that of the rest of the spring portion. Thus, the protrusion of the accommodating hole can reliably and stably make contact with the spring portion at the bridge cut mark thereof.

Effects of the Invention

According to the connector of the present invention, attachment of the connector to a flat cable and the electrical connection between a socket terminal of the connector and a land of the flat cable can be performed by inserting the flat cable into the connector, so that a work for connecting to the flat cable can be extremely simply performed.

DESCRIPTION OF REFERENCE NUMERALS

Figure 1:
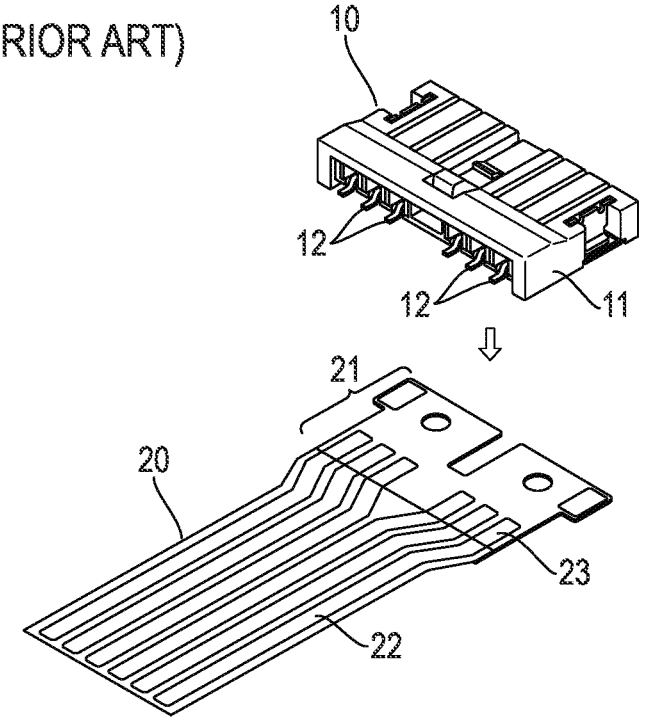
Fig. 1 (PRIOR ART)
FIG. 1 is a perspective view showing an aspect in which a conventional connector (plug connector) is attached to an FPC.
Figure 2:
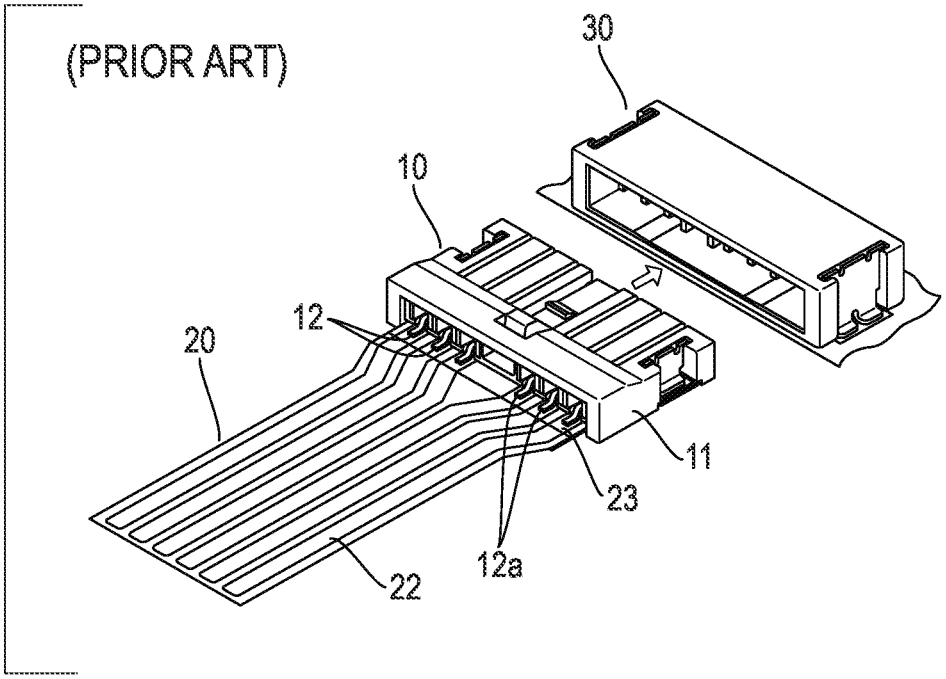
FIG. 2 is a perspective view showing an aspect in which the conventional connector (plug connector) is fitted into a receptacle connector.
Figure 3A:
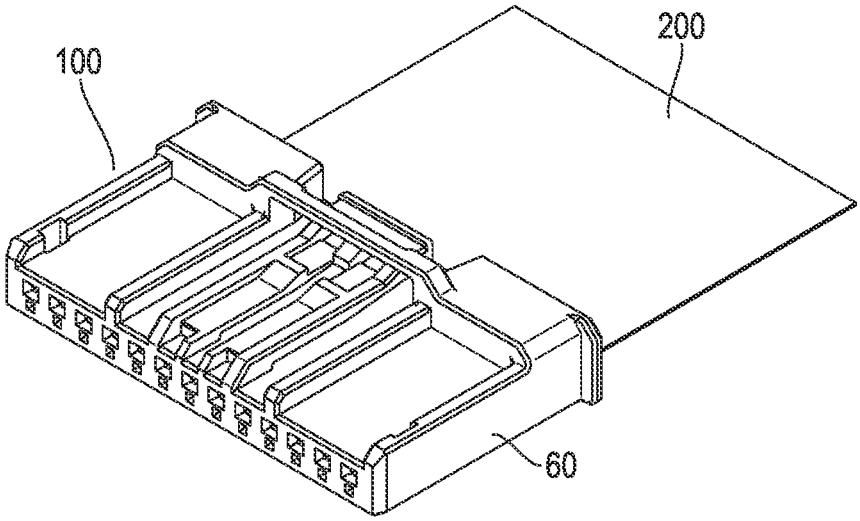
FIG. 3A is a perspective view of an embodiment of a connector according to the present invention when viewing the connector from a front side.
Figure 3B:
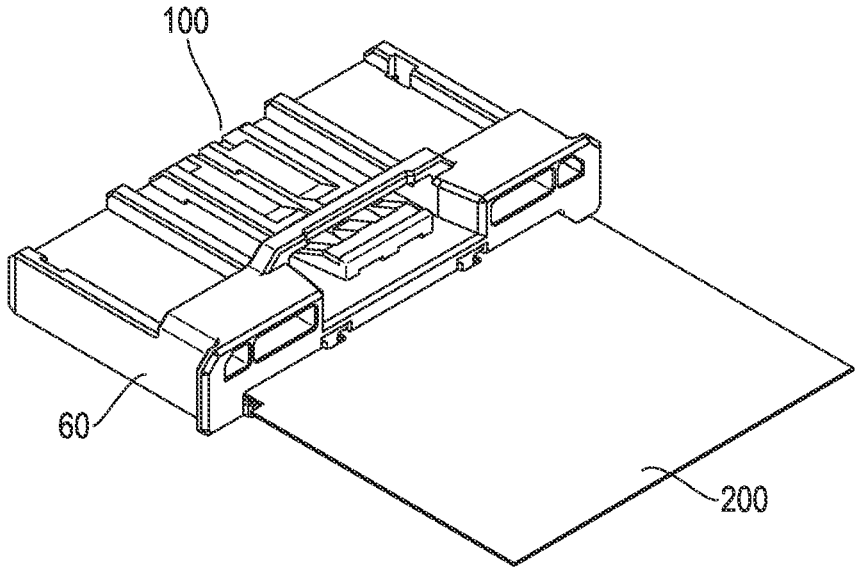
FIG. 3B is a perspective view of the connector when viewing the connector shown in FIG. 3A from a rear side.
Figure 4:
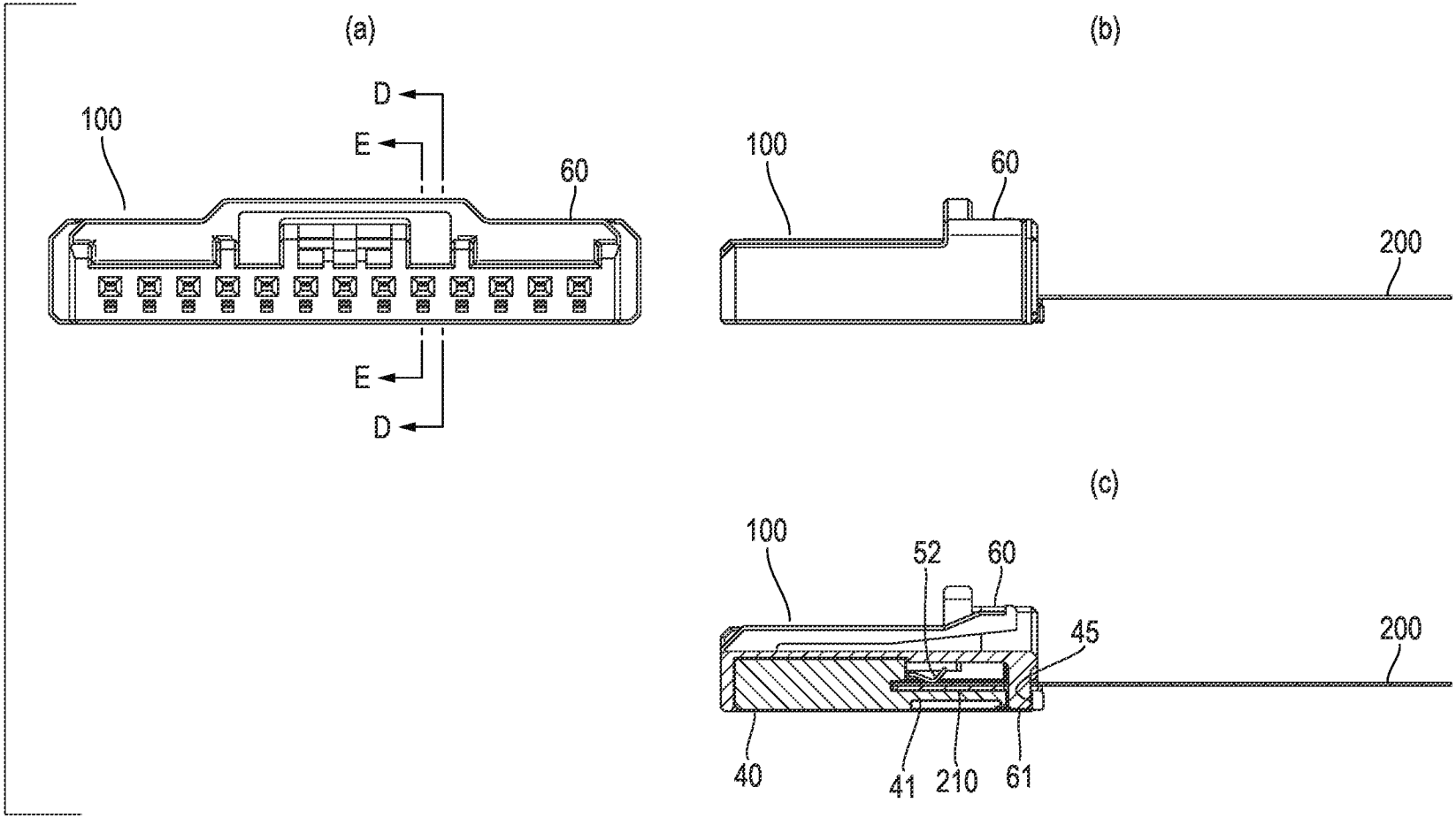
FIG. 4 is a diagram showing the connector shown in FIG. 3A, wherein (a) of FIG. 4 is a front view of the connector shown in FIG. 3A, (b) of FIG. 4 is a side view of the connector shown in FIG. 3A, and (c) of FIG. 4 is a sectional view taken along line D-D of (a) of FIG. 4.

10 plug connector
11 Plug housing
12 plug terminal
12*a* coupling part
20 FPC
21 connection region
22 conductor layer
23 FPC terminal
30 receptacle connector
40 housing
41 plate-shaped part
41*a* top surface
42 terminal accommodating part
43 accommodating hole
44 protruding part
45 insertion hole
46 protruding piece
46*a* protrusion
47 protrusion
48 protrusion
50 socket terminal
51 box part
51*a* rear end
51*b*, 51*c* side wall
51*d* upper plate part
52 spring piece
52*a* slope part
52*b* horizontal part
52*c* contact part
53, 54 internal spring piece
55 protruding part
56, 57 window
58 protrusion
59*a*, 59*b*, 59*c* bridge cut mark
60 cover
61 protruding part
62 lock arm
100 connector
200 FPC
201 land
210 reinforcing plate
220 hole
300 counterpart connector

DETAILED DESCRIPTION OF THE EMBODIMENTS

An embodiment of the present invention will be described by way of examples with reference to the drawings.

FIGS. 3A, 3B, 4 and 5A show an embodiment of a connector according to the present invention which is attached to a terminal of an FPC (FPC cable). A connector 100 comprises a housing 40, socket terminals 50, and a cover 60. In this example, the FPC 200 is configured such that a reinforcing plate 210 is attached to a terminal to be connected to the connector 100.

Figure 6:
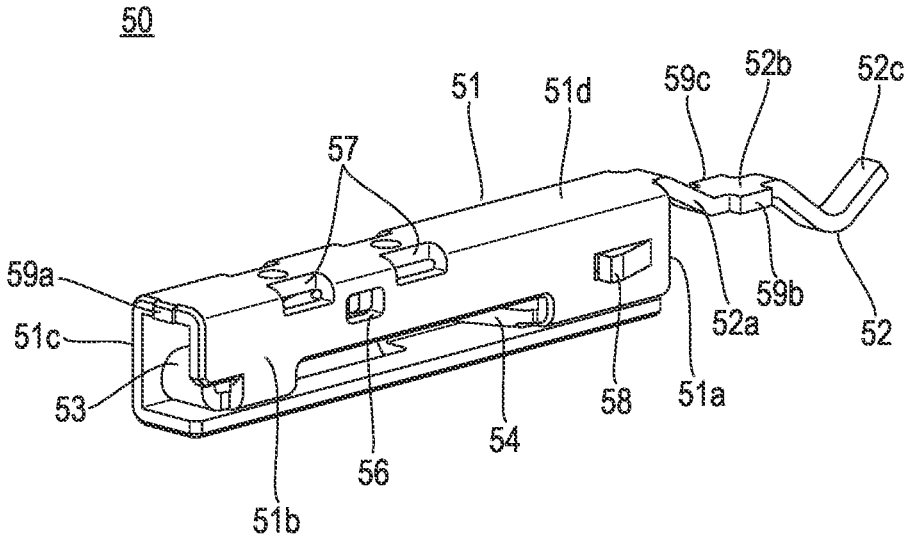
FIG. 6 is a perspective view of a socket terminal in FIG. 5A.

FIG. 6 shows the details of a socket terminal 50, and FIGS. 7A, 7B, 8A and 8B show an aspect in which assembly of the connector 100 and attachment of the connector 100 to the terminal of the FPC 200 are performed in order.

As shown in FIG. 6, the socket terminal 50 comprises a box part 51 having a square tubular outer shape into which a pin terminal of a counterpart connector is to be inserted, and a spring piece 52 having a cantilever shape, the spring piece 52 extending rearward from a rear end 51*a* of the box part 51.

Figure 5A:
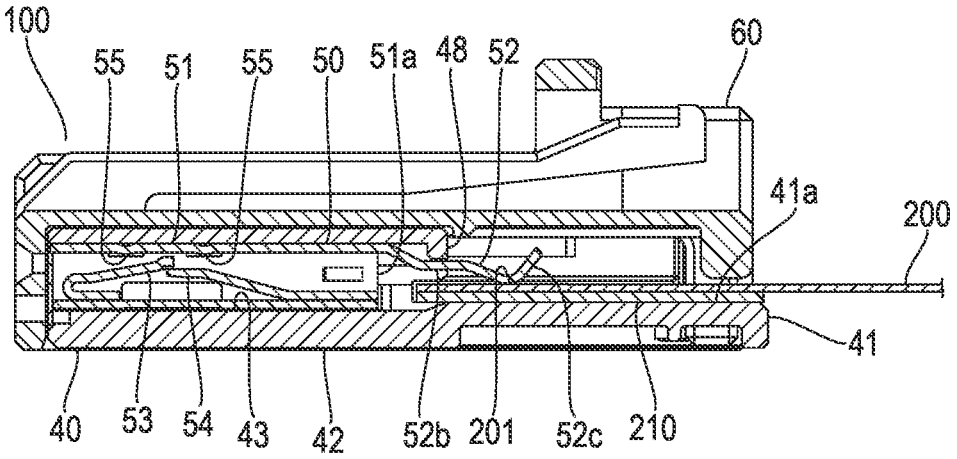
FIG. 5A is an enlarged cross-sectional view taken along line E-E of (a) of FIG. 4.

As shown in FIG. 5A, a pair of internal spring pieces 53 and 54 are provided inside the box part 51 so as to be arranged in a front-rear direction of the box part 51, and so that free ends thereof overlap each other. These internal spring pieces 53 and 54 are bent and extended from a lower end side of one side wall 51*b* of the box part 51.

As shown in FIG. 5A, two protruding parts 55 protruding to the inner surface side are formed on an upper plate part 51*d* of the box part 51, and the inner spring piece 53 whose spring force is reinforced by these protruding parts 55 and the internal spring piece 54 serves as a contact part which contacts the pin terminal of the counterpart connector inserted into the box part 51 while pinching the pin terminal of the counterpart connector.

Windows 56 for checking the position (height position) of the internal spring piece 53 are formed on a pair of side walls 51*b* and 51*c* of the box part 51, and two windows 57 for checking the heights of the two protruding parts 55 are formed at each of corner portions formed by the side walls 51*b* and 51*c* and the upper plate part 51*d*. Further, protrusions 58 are formed on the pair of side walls 51*b* and 51*c* by cutting and raising outward respective parts of the side walls 51*b* and 51*c*.

The spring piece 52 extends from the upper plate part 51*d* of the box part 51, and comprises a slope part 52*a* which slopes and extends downward from the upper plate part 51*d* of the box part 51, a horizontal part 52*b* following the slope part 52*a*, and a contact part 52*c* following the horizontal part 52*b*. The contact part 52*c* has such a shape as to be bent in an L-shape in a direction in which the tip (free end) thereof faces upward.

The socket terminal 50 having the foregoing shape is formed by pressing a metal plate. In FIG. 6, 59*a* to 59*c* indicate bridge cut marks. In this example, the contact part 52*c* on the tip end side of the spring piece 52 is gold-plated.

As shown in FIG. 6, the bridge cut mark 59*a* is located at the front end of the box part 51, and the bridge cut marks 59*b* and 59*c* are located on both sides in the width direction of the horizontal part 52*b* of the spring piece 52. The reason why the bridges are provided not only on the box part 51, but also on the spring piece 52 as described above is to stabilize the shape and quality in the press working and the plating processing. Note that the entire contact part 52*c* can be excellently plated by providing the bridge cut marks 59*b* and 59*c* on the horizontal part 52*b* in the spring piece 52.

Figure 7A:
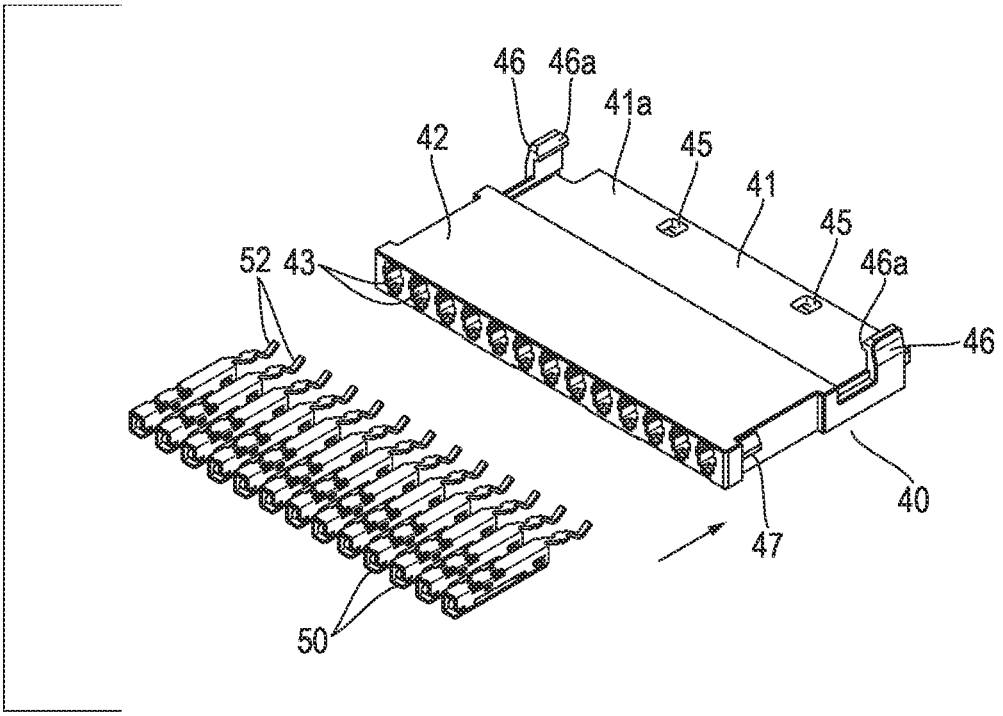
FIG. 7A is a diagram (part 1) showing an assembly of the connector shown in FIG. 3A.

As shown in FIG. 7A, the housing 40 includes a plate-shaped part 41 and a terminal accommodating part 42 following the plate-shaped part 41. The terminal accommodating part 42 has a flat rectangular parallelepiped shape. Accommodating holes 43 are formed through the terminal accommodating part 42 so as to be arranged in a row and so that the rear ends of the accommodating holes 43 open toward the plate-shaped part 41. In this example, thirteen accommodating holes 43 are formed.

The socket terminal 50 is to be inserted into each of these accommodating holes 43. As shown in FIG. 7A, the socket terminal 50 is inserted into the accommodating hole 43 from a front side of the terminal accommodating part 42 (a side opposite to a side where the plate-shaped part 41 is located) with the spring piece 52 being placed at the head.

Figure 9:
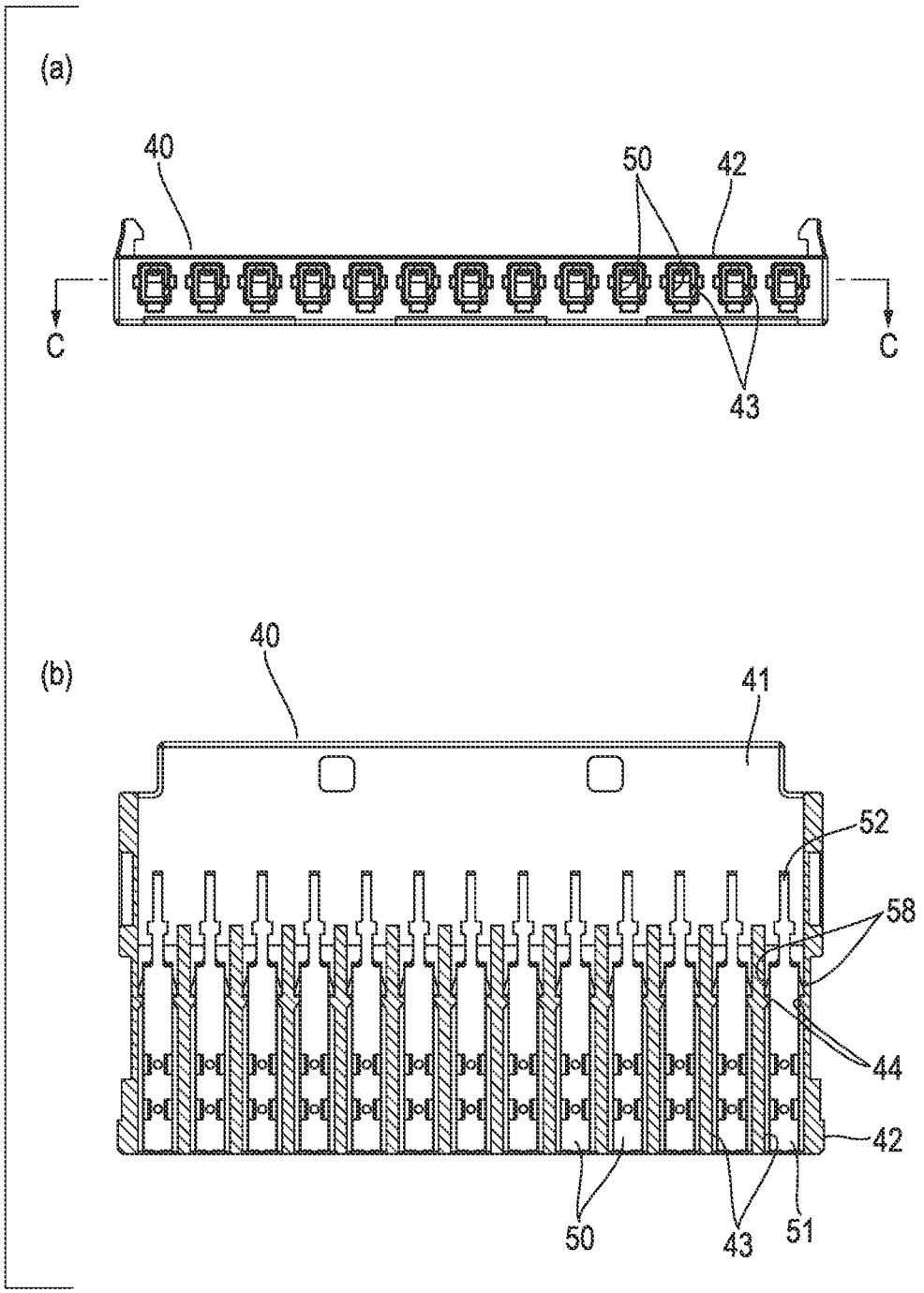
FIG. 9 is a diagram showing the connector, wherein (a) of FIG. 9 is a front view showing a state in which the socket terminal is housed and held in a housing, and (b) of FIG. 9 is a cross-sectional view taken along line C-C of (a) of FIG. 9.

FIG. 9 shows a state in which the socket terminals 50 are housed in the accommodating holes 43 of the terminal accommodating part 42 of the housing 40. The pair of protrusions 58 provided on the box part 51 of each socket terminal 50 are hooked to protruding parts 44 on the inner surface of each accommodating hole 43 so as to protrude from the inner surface of the accommodating hole 43, whereby the socket terminals 50 are prevented from coming off and are retained in the accommodating holes 43. Note that the spring pieces 52 of the socket terminals 50 are located so as to protrude onto the plate-shaped part 41 of the housing 40.

Figure 7B:
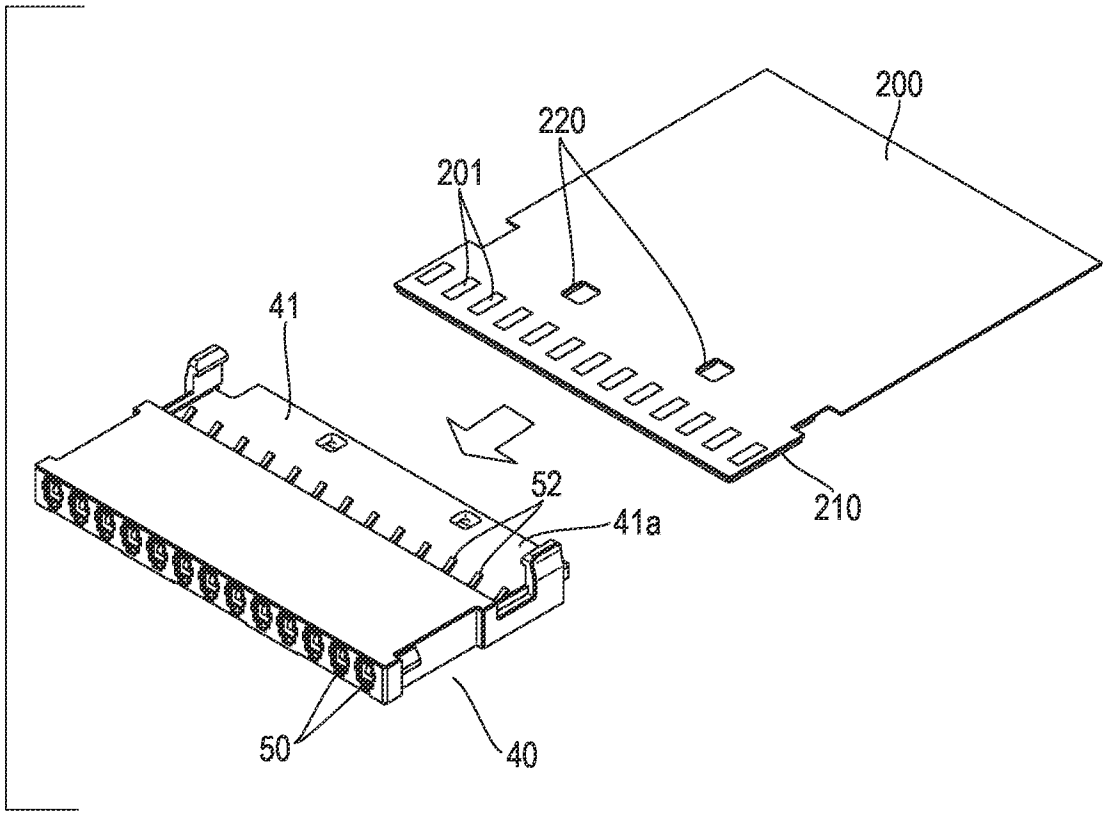
FIG. 7B is a diagram (part 2) showing the assembly of the connector shown in FIG. 3A.

In this way, the FPC 200 is attached to the housing 40 with the socket terminals 50 being attached to the housing 40. As shown in FIG. 7B, the FPC 200 is to be inserted from the rear side of the plate-shaped part 41 along the upper surface 41*a* of the plate-shaped part 41, and put in between the plate-shaped part 41 and the spring pieces 52 of the socket terminals 50.

Figure 5B:
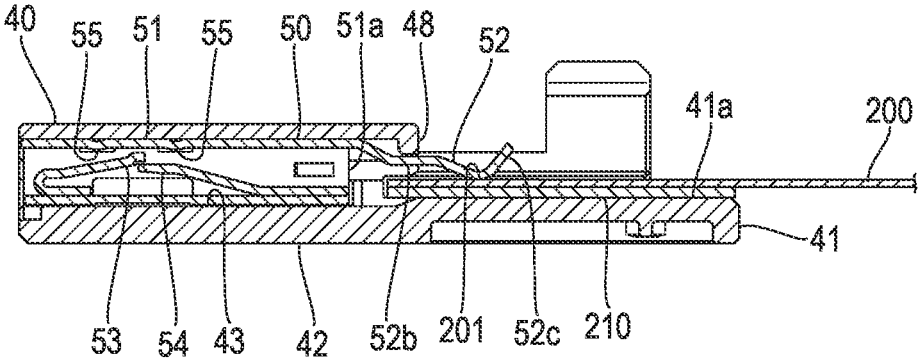
FIG. 5B is an enlarged cross-sectional view taken when a cover is removed in FIG. 5A.

FIG. 5B shows a state in which the terminal of the FPC 200 is inserted and put in between the plate-shaped part 41 of the housing 40 and the spring piece 52 of the socket terminal 50 located on the plate-shaped part 41 to attach the FPC 200. The terminal of the FPC 200 is pinched and mechanically connected by the plate-shaped part 41 and the spring pieces 52 of the socket terminals 50, and also the spring pieces 52 come into contact with the lands 201 arranged on the terminal of the FPC 200 respectively, whereby the thirteen socket terminals 50 are electrically connected to the lands 201 of the FPC 200, respectively. The terminal accommodating part 42 of the housing 40 receives force that the spring pieces 52 receive from the FPC 200.

Figure 8A:
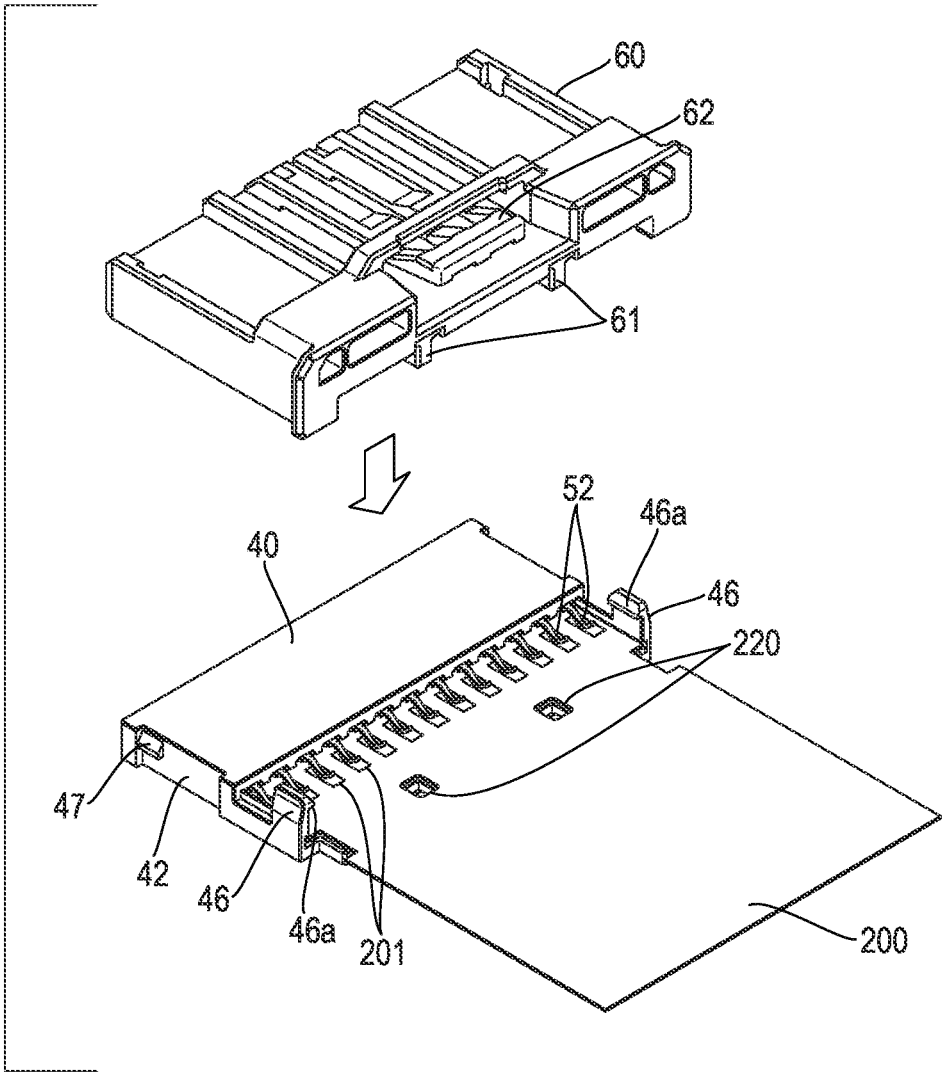
FIG. 8A is a diagram (part 3) showing the assembly of the connector shown in FIG. 3A.

The cover 60 is attached after the FPC 200 is attached as described above. The cover 60 is attached to the housing 40 from the upper side of the housing 40 as shown in FIG. 8A. At this time, in this example, two protruding parts 61 provided on the cover 60 pass through two holes 220 in the reinforcing plate 210 in the terminal of the FPC 200, and inserted into two insertion holes 45 in the plate-shaped part 41 of the housing 40, thereby preventing the FPC 200 from coming off.

Figure 8B:
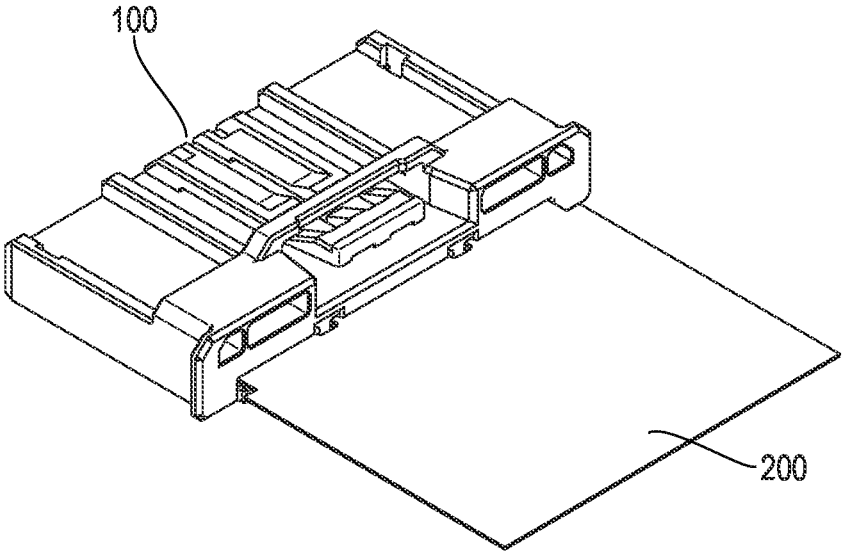
FIG. 8B is a diagram showing an assembly completed state.

With respect to the fixing of the cover 60 to the housing 40, protrusions 46*a* formed at the tips of protruding pieces 46 which are formed at both ends in the width direction of the plate-shaped part 41 of the housing 40 so as to protrude from the plate-shaped part 41, and protrusions 47 which are formed on both side surfaces in the width direction of the terminal accommodating part 42 are hooked to the cover 60 inside the cover 60, whereby the cover 60 is fixed to the housing 40. FIG. 8B shows a state in which the FPC 200 has been attached and thus the assembly of the connector 100 is completed as in the case of FIG. 3B.

According to the connector 100 described above, the socket terminal 50 include the spring piece 52 located on the plate-shaped part 41 of the housing 40, and the FPC 200 and the connector 100 can be connected to each other by merely inserting and putting the terminal of the FPC 200 in between the spring piece 52 and the plate-shaped part 41. Therefore, the connector 100 can be attached to the FPC 200 extremely simply.

In order to stabilize the shape and quality of the socket terminals 50 formed by the press working, the spring piece 52 is also provided with the bridges, and as described above, the portions at which the bridges are provided, that is, the spring piece 52 has the horizontal part 52*b* at which the bridge cut marks 59*b* and 59*c* are located. The existence of the horizontal part 52*b* as described above increases the length of the spring piece 52, and weakens the spring force, but this example has a structure for strengthening the spring force. This point will be described below.

As shown in FIGS. 5A and 5B, in this example, each accommodating hole 43 of the terminal accommodating part 42 of the housing 40 has, at an inner surface thereof, a protrusion 48 that protrudes from the inner surface. The protrusion 48 functions, while the spring piece 52 is in contact with the land 201, as a fixed end of the spring piece 52 by locating between the tip (free end) of the spring piece 52 and a rear end 51*a* of the box part 51 from which the spring piece 52 extends, and receives the force that the spring piece 52 receives from the FPC 200. The provision of such a protrusion 48 shortens the effective length of the spring piece 52, which makes it possible to strengthen the spring force. Note that the protrusion 48 is in contact with the horizontal part 52*b* of the spring piece 52 to restrict the movement of the horizontal part 52*b*, and the horizontal part 52*b* is used as a substantially fixed end.

The embodiment of the present invention has been described above. The FPC 200 is prevented from coming off by protruding parts 61 of the cover 60, and therefore even when external force such as pulling force is applied to the FPC 200, the contact part between the spring piece 52 and the land 201 is not affected by the external force, and is kept in an excellent contact state.

Further, in order to strengthen the connection state between the spring piece 52 and the land 201 more greatly, the contact part between the spring piece 52 and the land 201 may be subjected to not only spring connection, but also soldering-based connection according to a condition for use. Since the contact part 52*c* of the spring piece 52 is entirely plated, soldering can be excellently performed. Further, as shown in FIG. 5B, the upper side of the spring piece 52 is opened in a state where the terminal of the FPC 200 is inserted and put in between the plate-shaped part 41 and the spring piece 52, so that a soldering work and an inspection on a soldered state can be easily performed.

Since the spring pieces 52 and the lands 201 are covered by the cover 60, it is possible to avoid dust or the like from entering the contact parts between the spring pieces 52 and the lands 201 and causing the contact parts to be soiled.

Figure 10:
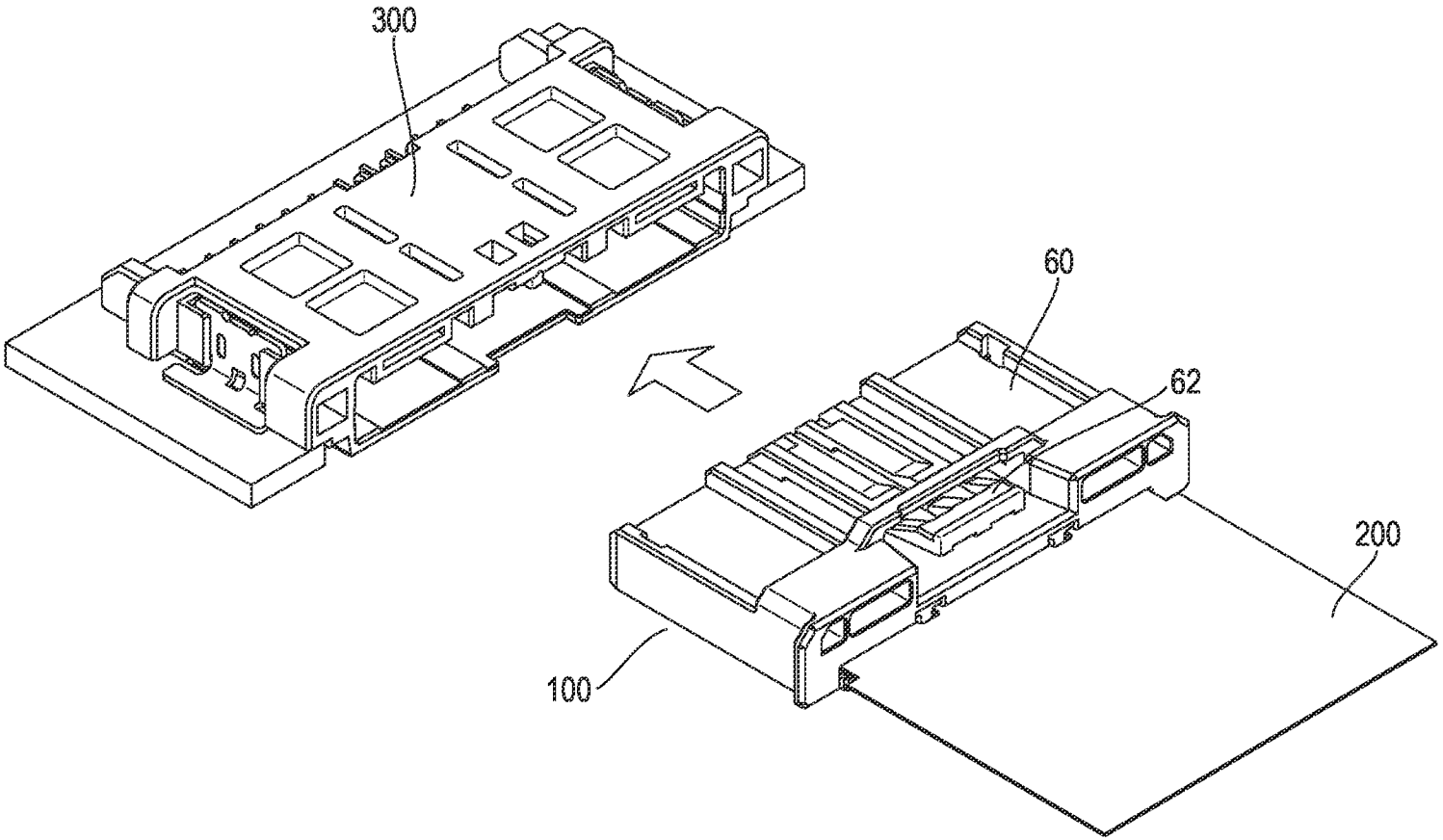
FIG. 10 is a perspective view showing an aspect in which the connector shown in FIG. 3A is connected to a counterpart connector.
Figure 11:
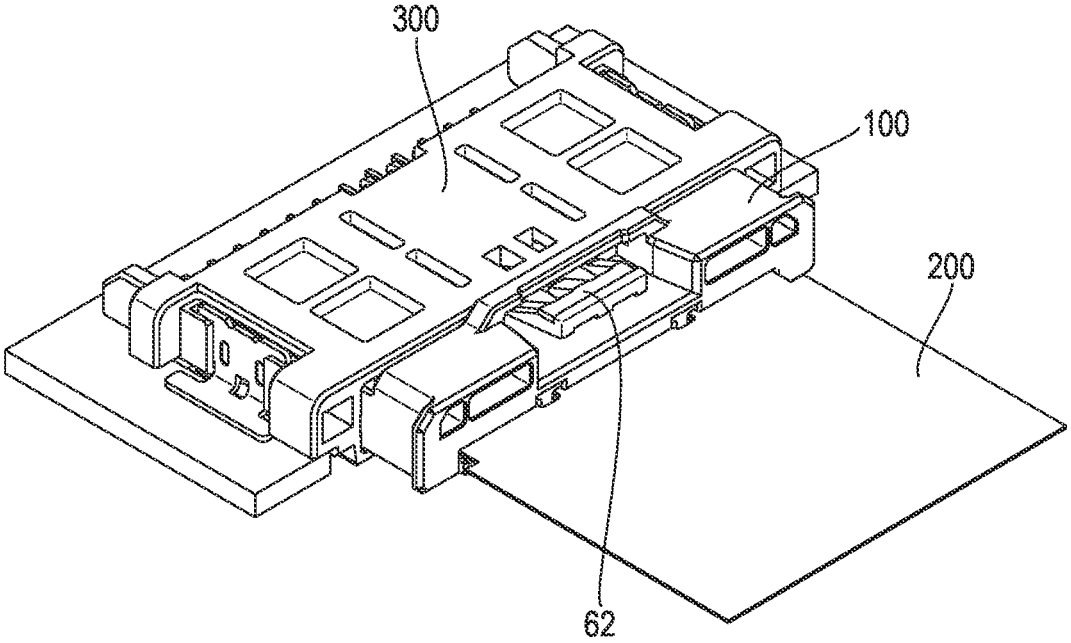
FIG. 11 is a perspective view showing a connection state between the connector shown in FIG. 3A and the counterpart connector.

FIG. 10 shows an aspect in which the connector 100 described above is connected to a counterpart connector 300, and FIG. 11 shows a state in which the connection between the connector 100 and the counterpart connector 300 is completed. The cover 60 is provided with a lock arm 62 which is hooked to the counterpart connector 300 to maintain the connection.

What is claimed is:

1. A connector connectable to a counterpart connector, the counterpart connector having pin terminals, the connector being attachable to a flat cable at an end of the flat cable, and the flat cable having lands for electrical contacts, the connector comprising:

a housing including a plate-shaped portion and a terminal accommodating portion continuous with the plate-shaped portion, the terminal accommodating portion having accommodating holes, each of the accommodating holes penetrating through the terminal accommodating portion and having an end opening to the plate-shaped portion;

socket terminals respectively held in the accommodating holes, each of the socket terminals including a box portion and a spring portion, the box portion being used for receiving a corresponding one of the pin terminals of the counterpart connector, and the spring portion having a cantilever shape and extending from the box portion, through the end of a corresponding one of the accommodating holes, onto the plate-shaped portion; and a cover attachable to the housing of the connector and configured to cover the lands and every spring portion, wherein the spring portion is configured to:

in response to insertion of the end of the flat cable, separate from the plate-shaped portion in order to make space for the end of the flat cable;

make contact with a corresponding one of the lands of the flat cable after the insertion of the end of the flat cable; and make contact with the terminal accommodating portion to transmit to the terminal accommodating portion part of force that the spring portion receives from the end of the flat cable, the flat cable is designed to have a through-hole, the plate-shaped portion has an insertion hole, and the cover has a protruding portion configured to pass through the through-hole in the flat cable and thus to go into the insertion hole.

2. The connector according to claim 1, wherein each of the accommodating holes of the terminal accommodating portion has, at an inner surface thereof, a protrusion protruding from the inner surface, and after the insertion of the end of the flat cable, the protrusion serves as a supporter to give the spring portion a support point located between a base end of the spring portion and a free end of the spring portion, and receives the part of force that the spring portion receives from the flat cable.

3. The connector according to claim 1, wherein the spring portion has a bridge cut mark located between a base end of the spring portion and a contact portion of the spring portion that is used for a contact with the corresponding one of the lands, the bridge cut mark being an evidence of cutting of a bridge used for connecting the socket terminals to each other in a manufacturing process of the socket terminals, and the contact portion in whole is plated.

4. The connector according to claim 2, wherein the spring portion has a bridge cut mark located between a base end of the spring portion and a contact portion of the spring portion that is used for a contact with the corresponding one of the lands, the bridge cut mark being an evidence of cutting of a bridge used for connecting the socket terminals to each other in a manufacturing process of the socket terminals, and the contact portion in whole is plated.

* * * * *